US010933657B2

(12) United States Patent
Horaguchi

(10) Patent No.: US 10,933,657 B2
(45) Date of Patent: Mar. 2, 2021

(54) PRINTING APPARATUS AND METHOD OF CONTROLLING PRINTING APPARATUS

(71) Applicant: SEIKO EPSON CORPORATION, Tokyo (JP)

(72) Inventor: Norio Horaguchi, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/664,416

(22) Filed: Oct. 25, 2019

(65) Prior Publication Data

US 2020/0130374 A1 Apr. 30, 2020

(30) Foreign Application Priority Data

Oct. 26, 2018 (JP) ..... JP2018-201522

(51) Int. Cl.
*B41J 2/355* (2006.01)
*B41J 2/32* (2006.01)
*B41J 2/35* (2006.01)

(52) U.S. Cl.
CPC ..... *B41J 2/3551* (2013.01); *B41J 2/32* (2013.01); *B41J 2/35* (2013.01)

(58) Field of Classification Search
CPC ..... B41J 2/3551; B41J 2/32; B41J 2/36; B41J 2/35
See application file for complete search history.

(56) References Cited

U.S. PATENT DOCUMENTS

| | | | | |
|---|---|---|---|---|
| 7,004,654 | B2 | 2/2006 | Shibata et al. | |
| 9,333,781 | B2 | 5/2016 | Qu et al. | |
| 2004/0184862 | A1 | 9/2004 | Shibata et al. | |
| 2005/0243115 | A1 | 11/2005 | Kang et al. | |
| 2008/0056793 | A1* | 3/2008 | Yokoyama | B41J 2/325 400/120.02 |
| 2015/0266324 | A1 | 9/2015 | Qu et al. | |
| 2018/0104968 | A1* | 4/2018 | Okamura | B41J 3/38 |
| 2018/0111396 | A1* | 4/2018 | Aihara | B41J 2/32 |
| 2018/0222223 | A1* | 8/2018 | Lim | B41J 15/042 |
| 2018/0257396 | A1* | 9/2018 | Ogawa | B41J 2/3558 |

FOREIGN PATENT DOCUMENTS

| | | |
|---|---|---|
| CN | 1537058 | 10/2004 |
| CN | 1704250 | 12/2005 |
| CN | 103722907 | 4/2014 |
| JP | 2013-193244 | 9/2013 |

* cited by examiner

*Primary Examiner* — Henok D Legesse
(74) *Attorney, Agent, or Firm* — Workman Nydegger

(57) ABSTRACT

A level change point detection section detects a level change point, at which an output level switches, in a first position detection signal Ens1 generated by an encoder or a second position detection signal obtained by increasing the resolution of the Ens1. Each time a predetermined number of level change points is detected, an energization timing determination section determines the timing, at which the predetermined number of level change points have been detected, to be an energization timing for the thermal head.

8 Claims, 7 Drawing Sheets

PRINTING APPARATUS AND METHOD OF CONTROLLING PRINTING APPARATUS

The present application is based on, and claims priority from JP Application Serial Number 2018-201522, filed Oct. 26, 2018, the disclosure of which is hereby incorporated by reference herein in its entirety.

BACKGROUND

1. Technical Field

The present disclosure relates to a printing apparatus and a method of controlling the printing apparatus.

2. Related Art

In the related art, printing apparatuses that perform printing by applying thermal energy to thermal paper or heat-sensitive ink with a thermal head have been available. Printing apparatuses of this type typically has a configuration in which the paper feed driving is performed with a stepping motor (see, e.g., Japanese Unexamined Patent Application Publication No. 2013-193244).

In the case where the paper feed driving is performed with a stepping motor, printing is performed by matching the paper feed amount per step of the stepping motor with the print resolution of the thermal head, and by energizing the thermal head each time the paper is fed by one step. In this case, the timing of energizing the thermal head is a fixed timing that is determined by the resolution of the stepping motor.

SUMMARY

One object of the present disclosure is to provide a printing apparatus capable of easily changing the energization timing for the thermal head in accordance with the print resolution of the thermal head, and a method of controlling the printing apparatus.

As a preferable aspect for attaining the above-described object, a printing apparatus includes: a transport roller configured to transport a recording medium; a DC motor configured to drive the transport roller; a thermal head including a plurality of heating members that generate heat when energized; an encoder configured to output a first detection pulse in response to a rotation of the DC motor; and a processor configured to control the DC motor and the thermal head. The processor measures a number of the first detection pulses output by the encoder, starts energization for the thermal head when the number of the first detection pulses measured by the processor becomes a predetermined number, and changes, in accordance with a print resolution of the thermal head, an energization timing for starting the energization for the thermal head.

In the printing apparatus, the encoder may output one of the first detection pulses each time the DC motor rotates by a predetermined angle, and, when the DC motor rotates by the predetermined angle, a transport amount of the recording medium by the transport roller may be ⅓ or less of a spacing between the heating members provided in the thermal head.

In the printing apparatus, the processor may determine an energization time corresponding to an nth energization timing, based on a time from an n−1th energization timing to the nth energization timing, and, in a case where there is an n+1th energization timing in a period from the nth energization timing until elapse of the energization time, the processor may start the energization time corresponding to the n+1th energization timing without elapse of the energization time corresponding to the nth energization timing.

In the printing apparatus, the processor may detect a rotational speed of the DC motor, control an energization amount for the DC motor to reduce a difference between a detected actual rotational speed of the DC motor and a predetermined target rotational speed of the DC motor, and determine a type of the recording medium on a basis of the energization amount for the DC motor.

In the printing apparatus, the processor may detect a rotational speed of the DC motor, control an energization amount for the DC motor to reduce a difference between a detected actual rotational speed of the DC motor and a predetermined target rotational speed of the DC motor, and detect an abnormality, based on the energization amount for the DC motor.

In the printing apparatus, the encoder may be provided to a rotational shaft of the transport roller.

In the printing apparatus, the encoder may be provided to a rotational shaft of the DC motor.

As a preferable aspect for attaining the above-described object, in a method of controlling a printing apparatus, the printing apparatus includes a transport roller configured to transport a recording medium, a DC motor configured to drive the transport roller, a thermal head including a plurality of heating members that generate heat when energized; and an encoder configured to output a first detection pulse in response to a rotation of the DC motor, the method including measuring a number of the first detection pulses output by the encoder, starting energization for the thermal head when the number of the first detection pulses measured becomes a predetermined number, and changing, in accordance with a print resolution of the thermal head, an energization timing for starting the energization for the thermal head.

The aspects for attaining the above-described object may be realized in various forms other than the above-described printing apparatus and method of controlling the printing apparatus. For example, it is possible to achieve the object with a computer or a program of a processor for realizing the printing apparatus and the method of controlling the printing apparatus. Further, it is possible to achieve the object with a recording medium in which the above-described program is recorded, a server device for delivering the program, a transmission medium for transmitting the program, a data signal in which the above-described program is embodied in carrier waves, and the like.

DESCRIPTION OF EXEMPLARY EMBODIMENTS

1. Configuration of Printing Apparatus

Figure 1:
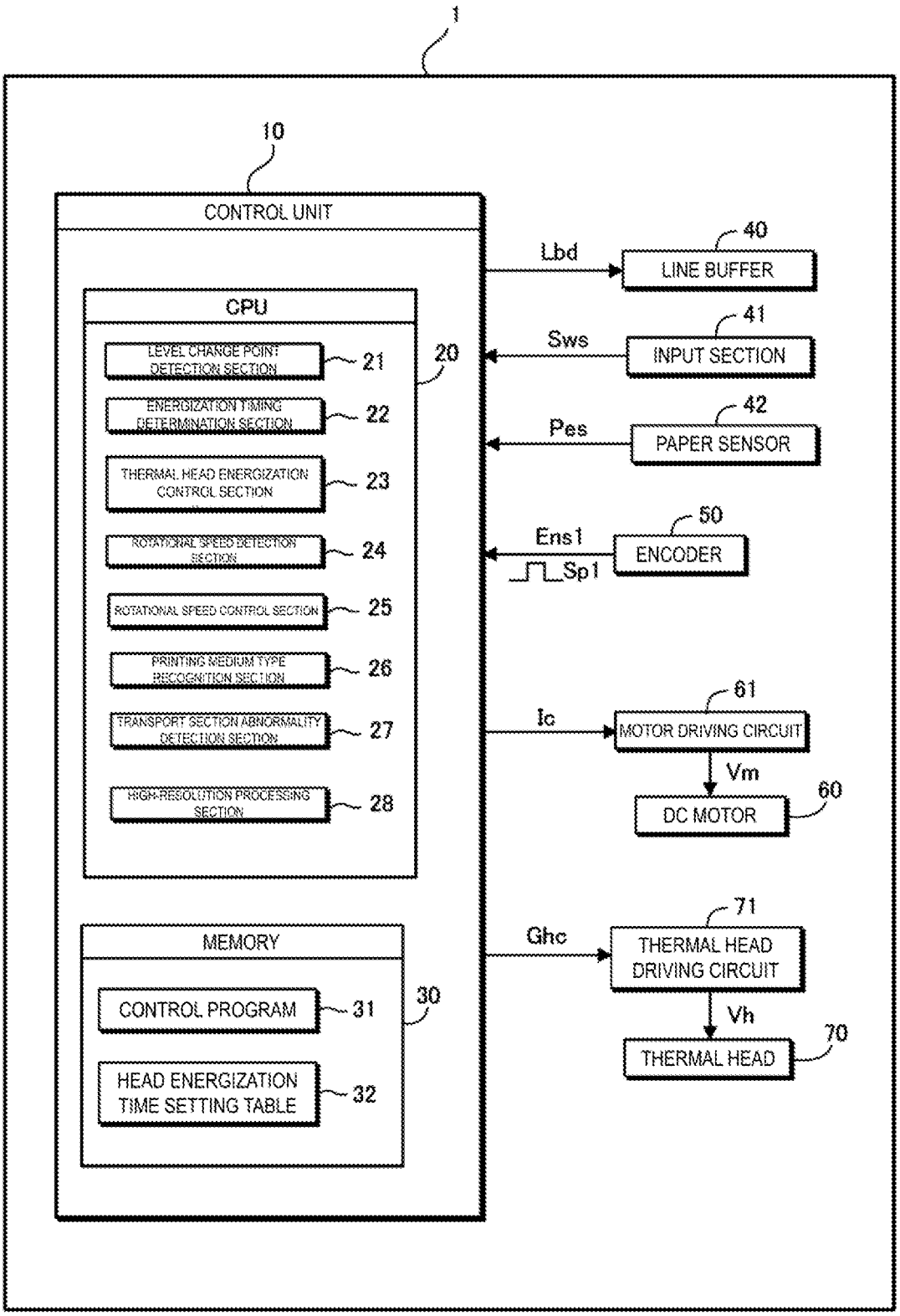
FIG. 1 is an overall configuration diagram of a printing apparatus.
Figure 2:
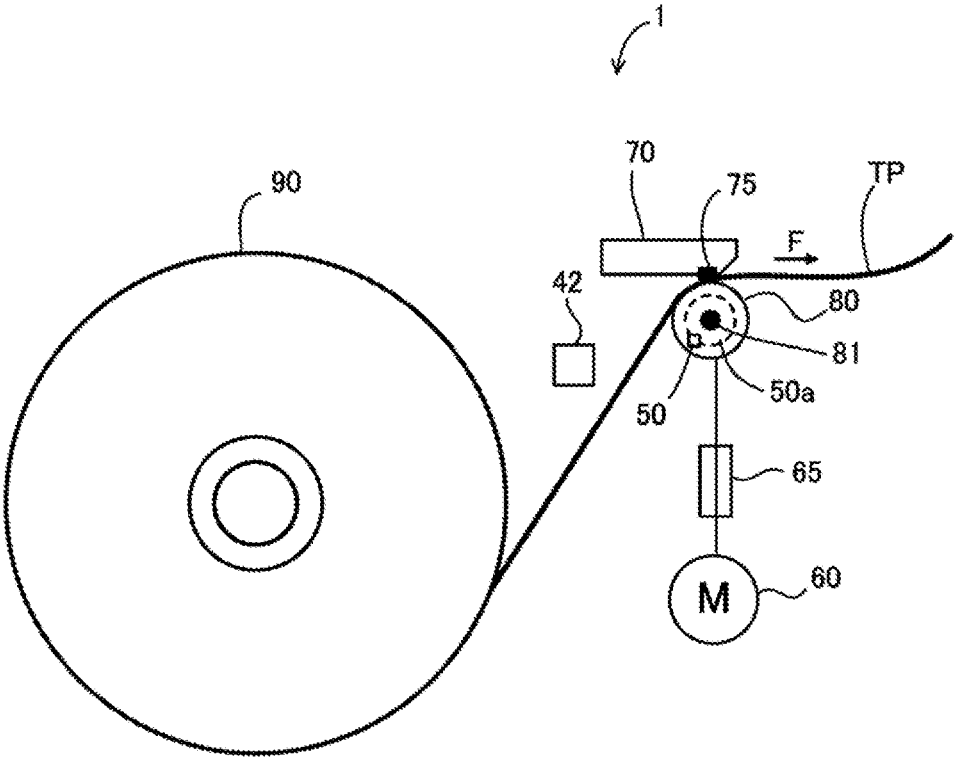
FIG. 2 is an explanatory diagram of a main part of the printing apparatus.
Figure 3:
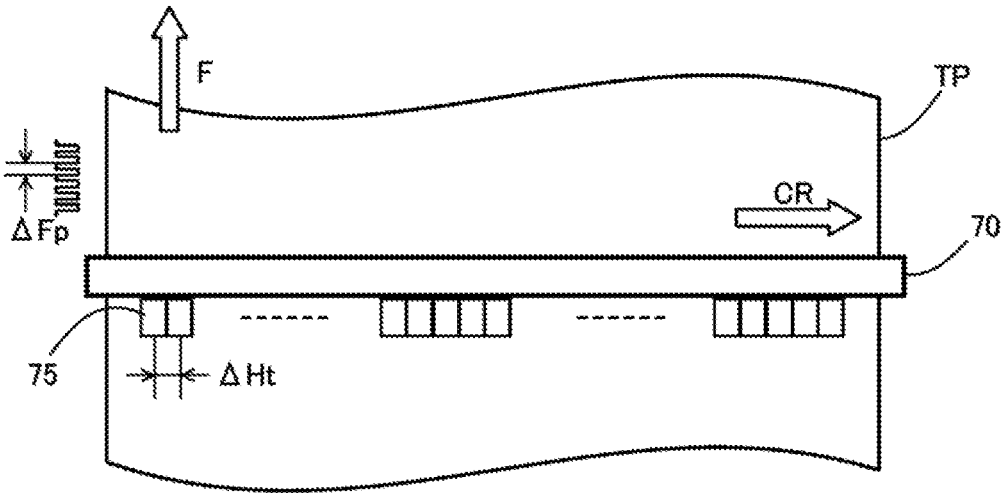
FIG. 3 is an explanatory diagram of a print resolution of a thermal head and a transport resolution of thermal paper.

A configuration of a printing apparatus 1 according to an embodiment to which the present disclosure is applied is described with reference to FIGS. 1 to 3. The printing apparatus 1 is a thermal printer that performs printing on thermal paper. FIG. 1 is an overall configuration diagram of the printing apparatus 1, FIG. 2 is an explanatory diagram of a main part of the printing apparatus 1, and FIG. 3 is an explanatory diagram of a print resolution of a thermal head and a transport resolution of thermal paper.

As illustrated in FIG. 1, the printing apparatus 1 includes a control unit 10, a line buffer 40, an input section 41, a paper sensor 42, an encoder 50, a motor driving circuit 61, a DC motor 60, a thermal head driving circuit 71, and a thermal head 70. The control unit 10 is an electronic circuit unit composed of a CPU 20, a memory 30 and the like, and controls the overall operation of the printing apparatus 1. The CPU 20 may be composed of one or more processors. Details of the configuration of the control unit 10 will be described later.

The line buffer 40 is a storage region that temporarily stores print data Lbd for one dot line when the control unit 10 executes a printing process. The input section 41 outputs an operation signal Sws to the control unit 10 in response to an operation of a switch in an operation panel not illustrated or the like. The paper sensor 42 detects the presence or absence of thermal paper and outputs a detection signal Pes to the control unit 10.

The encoder 50 generates a first position detection signal Ens1 that outputs one first detection pulse Sp1 each time the DC motor 60 rotates a predetermined angle. The encoder 50 outputs the generated first position detection signal Ens1 to the control unit 10. The motor driving circuit 61 controls a motor drive voltage Vm by, for example, a pulse width modulation (PWM) control such that a current of a target current value Ic output from the control unit 10 is passed through the DC motor 60.

As illustrated in FIG. 2, the printing apparatus 1 performs printing on long thermal paper TP wound on a roll 90. The printing apparatus 1 includes a platen 80 that is provided on the transport path of the thermal paper TP and sends the thermal paper TP in a transport direction F. The platen 80 is rotated by a driving force that is transmitted from the DC motor 60 via a transmission mechanism 65. The DC motor 60, the transmission mechanism 65, and the platen 80 constitute a transport section of the present disclosure, and the DC motor 60 is a driving source of the transport section. The platen 80 corresponds to a transport roller of the present disclosure. The thermal paper TP corresponds to a recording medium of the present disclosure.

In the case where the DC motor 60 is used as the driving source of the transport section, the pulsation due to the feeding step that is generated in the case where a stepping motor is used as the driving source is not generated. As a result, the setting of the deceleration ratio that is performed for the purpose of matching the print resolution with the stepping motor can be freely changed, and it is thus possible to optimize the electrical efficiency and the power characteristics of the motor.

The encoder 50 is provided with a slit disc 50*a* disposed coaxially with a rotational shaft 81 of the platen 80. The platen 80 is driven to rotate along with the DC motor 60, and accordingly the encoder 50 outputs one first detection pulse Sp1 each time the DC motor 60 rotates a predetermined angle. In addition, the thermal paper TP is transported in response to the rotation of the platen 80, and accordingly the encoder 50 outputs one first detection pulse Sp1 each time the thermal paper TP is transported by a predetermined amount.

By providing the encoder 50 such that the slit disc 50*a* is disposed coaxially with the rotational shaft 81 of the platen 80, it is possible to reduce errors in position detection of the thermal paper TP due to mechanical factors such as backlash at the connection site in the transport section.

The thermal head 70 is disposed at a position opposite the platen 80 with the thermal paper TP therebetween. The thermal head 70 prints characters and images by applying thermal energy to the printing surface of the thermal paper TP so as to color the thermal paper TP. At least one of the platen 80 and the thermal head 70 is pressed against the other by a pressing force of a biasing member, such as a spring not illustrated. With this configuration, the platen 80 transports the thermal paper TP between the platen 80 and the thermal head 70 with the pressing force of the biasing member.

The thermal paper TP is fed from the roll 90 so as to be sandwiched between the platen 80 and the thermal head 70, and is transported in the direction indicated by F in FIG. 2 by the rotational force of the platen 80. During this transportation, characters and images are printed on the thermal paper TP by the thermal head 70. The printed thermal paper TP is ejected from a paper ejection port not illustrated, and is cut by a manual cutter not illustrated.

A plurality of heating members 75 are disposed in series at the bottom surface of the thermal head 70 that makes contact with the thermal paper TP. As illustrated in FIG. 3, the heating members 75 are disposed in series in the width direction of the thermal paper TP orthogonal to the transport direction F of the thermal paper TP. While the present embodiment describes an example in which a plurality of heating members 75 are disposed in a line, the plurality of heating members 75 may be arranged in a plurality of lines. Hereinafter, the transport direction F of the thermal paper TP is also referred to as a main scanning direction F, and a direction CR orthogonal to the transport direction F is also referred to as a secondary scanning direction CR.

For example, in the case where 600 heating members 75, each of which forms one dot on the thermal paper TP, are disposed, and the print range in the secondary scanning direction CR is 2 inches wide, the print resolution is 300 dpi (Dot Per Inch). In the present embodiment, the resolution of the encoder 50 is set such that one first detection pulse Sp1 is output each time the thermal paper TP is transported by $\Delta Fp$, and that the $\Delta Fp$ is ⅓ or less of the spacing between each the heating member 75. With such setting, printing in accordance with the thermal head 70 of various print resolutions is achieved as described later.

With reference to FIG. 1, in the control unit 10, the memory 30 stores a control program 31 for the printing apparatus 1 and a head energization time setting table 32 for setting the energization time per dot for the thermal head 70.

The CPU 20 functions as a level change point detection section 21, an energization timing determination section 22, a thermal head energization control section 23, and a rotational speed detection section 24 by reading and executing the control program 31 stored in the memory 30. Further, the CPU 20 functions as a rotational speed control section 25, a recording medium type recognition section 26, a transport section abnormality detection section 27, and a high-resolution processing section 28.

Here, the process performed by the level change point detection section 21 corresponds to a level change point detection step in the method of controlling the printing apparatus of the present disclosure, and the process performed by the energization timing determination section 22 corresponds to an energization timing determination step in the method of controlling the printing apparatus of the present disclosure. Further, the process performed by the thermal head energization control section 23 corresponds to a thermal head energization control step.

The level change point detection section 21 detects a level change point, which is a time point at which the output level switches, for the first position detection signal Ens1 output from the encoder 50. The energization timing determination section 22 counts the level change points detected by the level change point detection section 21, and determines the time point at which a predetermined number of level change points have been counted as the energization timing for the thermal head 70 each time the predetermined number of level change points are counted. As described later, the predetermined number is set in accordance with the print resolution of the thermal head 70.

The thermal head energization control section 23 executes energization control on the thermal head 70 in accordance with the energization timing determined by the energization timing determination section 22. The rotational speed detection section 24 detects the rotational speed of the DC motor 60 on the basis of the frequency of the first position detection signal Ens1 output from the encoder 50. The rotational speed control section 25 executes rotational speed control for controlling the rotational speed of the DC motor 60 by adjusting the energization amount for the DC motor 60 to reduce the difference between the rotational speed of the DC motor 60 detected by the rotational speed detection section 24 and the target rotational speed. The rotational speed control section 25 adjusts the energization amount in the rotational speed control by using a known technique such as PID control.

The recording medium type recognition section 26 determines the type of the thermal paper TP on the basis of the energization amount for the DC motor 60 during the execution of the rotational speed control of the DC motor 60 by the rotational speed control section 25. Here, the energization amount required for rotating the DC motor 60 at a predetermined speed differs depending on the transport resistance of the thermal paper TP. The transport resistance of the thermal paper TP differs depending on the type of the thermal paper TP. Accordingly, the recording medium type recognition section 26 can determine the type of the thermal paper TP on the basis of the energization amount for the DC motor 60 when the rotational speed of the DC motor 60 is controlled to a predetermined speed by the rotational speed control section 25.

The time for energizing the thermal head 70 that is required for printing differs depending on the type of the thermal paper TP. Accordingly, the thermal head energization control section 23 applies the type of the thermal paper TP recognized by the recording medium type recognition section 26 to the head energization time setting table 32 to acquire an appropriate energization time, and performs energization control on the thermal head 70 by using the acquired energization time.

When the rotational speed of the DC motor 60 is controlled to the target rotational speed by the rotational speed control section 25, the transport section abnormality detection section 27 recognizes a transport abnormality when the energization amount for the DC motor 60 becomes equal to or greater than a predetermined abnormality determination value. Here, the energization amount for the DC motor 60 does not become equal to or greater than the abnormality determination value when the thermal paper TP is normally transported, but the energization amount increases when the transport load is increased due to the pinching of the thermal paper TP, abnormalities in the platen 80, and the like. In view of this, the transport section abnormality detection section 27 recognizes a transport abnormality when the energization amount for the DC motor 60 becomes equal to or greater than the abnormality determination value.

The transport section abnormality detection section 27 provides an abnormality notification when recognizing an abnormality of the transport section. In addition, since the position of the thermal paper TP at the time when the abnormality has occurred can be identified based on the first position detection signal Ens1 output from the encoder 50, and the position where an abnormality has occurred can be notified to the operator.

The high-resolution processing section 28 generates a second position detection signal having a higher resolution than the first position detection signal Ens1 by performing a process of increasing the resolution by dividing one period of the first position detection signal Ens1 output from the encoder 50.

2. Process of Determining Energization Timing and Energization Time

Figure 4:
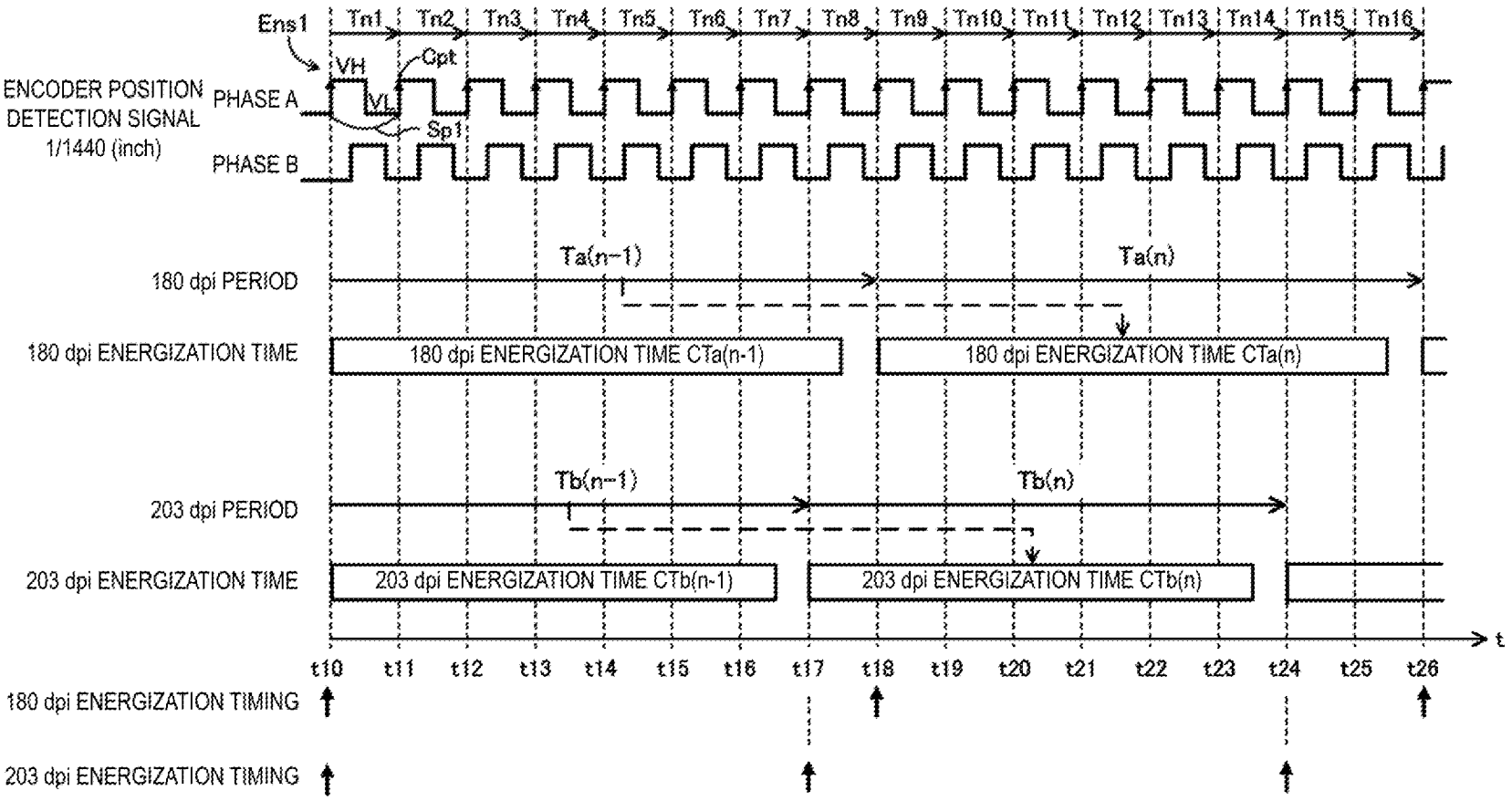
FIG. 4 is an explanatory diagram of an energization timing for a thermal head having different print resolutions.

With reference to FIG. 4, a process of determining an energization timing and an energization time for the thermal head 70 having print resolutions of 180 dpi and 203 dpi is described. FIG. 4 is an explanatory diagram of an energization timing for a thermal head having different print resolutions. FIG. 4 illustrates, in order from the upper side with respect to a common time axis t, a position detection signal output from the encoder 50, a period corresponding to 180 dpi, and an energization time corresponding to 180 dpi. Further, a period corresponding to 203 dpi, an energization time corresponding to 203 dpi, an energization timing corresponding to 180 dpi, and an energization timing corresponding to 203 dpi.

The encoder 50 outputs position detection signals of phase A and phase B shifted from each other by 90 degrees. The phase A and phase B are pulse signals whose output level switches between a first level VH and a second level VL each time the platen 80 rotates a predetermined angle. In the present embodiment, the position detection signal of the phase A is used as the first position detection signal Ens1 to determine the energization timing for the thermal head 70.

The level change point detection section 21 detects a time at which the output level has changed from the second level VL to the first level VH as a level change point Cpt. The energization timing determination section 22 determines the energization timing for the thermal head 70 by counting the level change point Cpt detected by the level change point detection section 21.

In the present embodiment, the resolution of the encoder 50 with respect to the transport amount of the thermal paper TP is set to 1440 pulses/inch. Accordingly, each time the thermal paper TP is transported by $1/1440$ inches, one first detection pulse Sp1 is output from the encoder 50 in the first position detection signal Ens1.

First, a process for the case where the print resolution of the thermal head 70 is 180 dpi is described. 180 dpi is $1/8$ of 1440 dpi, and accordingly the period of eight successive first detection pulses Sp1 is the period corresponding to 180 dpi. In FIG. 4, the printing start time point for the thermal paper TP is t10, and the periods of Tn1 to Tn8 and Tn9 to Tn16 of the eight first detection pulses Sp1 are control periods Ta(n−1) and Ta(n) corresponding to 180 dpi.

Accordingly, the energization timing determination section 22 determines time t18 at which eight level change points Cpt have been counted from t10, and time t26 at which eight level change points Cpt have been further counted thereafter as energization timings for the thermal head 70. The thermal head energization control section 23 determines the energization time CTa(n) for the thermal head 70 in the nth control period Ta(n) in accordance with the time of the preceding n−1th control period Ta(n−1). The thermal head energization control section 23 determines the energization time CTa(n) as a time shorter than the preceding control period Ta(n−1).

Next, a process for the case where the print resolution of the thermal head 70 is 203 dpi is described. 203 dpi is approximately $1/7$ of 1440 dpi, and accordingly the period of seven successive first detection pulses Sp1 is the period corresponding to 203 dpi. In FIG. 4, the printing start timing for the thermal paper TP is t10, and the periods of the Tn1 to Tn7 and Tn8 to Tn14 of the seven first position detection signals Ens1 are control periods Tb(n−1) and Tb(n) corresponding to 203 dpi.

Accordingly, the energization timing determination section 22 determines time t17 at which seven level change points Cpt have been counted from t10, and time t24 at which seven level change points Cpt have been further counted thereafter as energization timings for the thermal head 70. In addition, the thermal head energization control section 23 determines the energization time CTb(n) for the thermal head 70 in the present control period Tb(n) in accordance with the time of the preceding control period Tb(n−1). The thermal head energization control section 23 determines the energization time CTb(n) as a time shorter than the preceding control period Tb(n−1).

3. Process of Changing Energization Time

Figure 5:
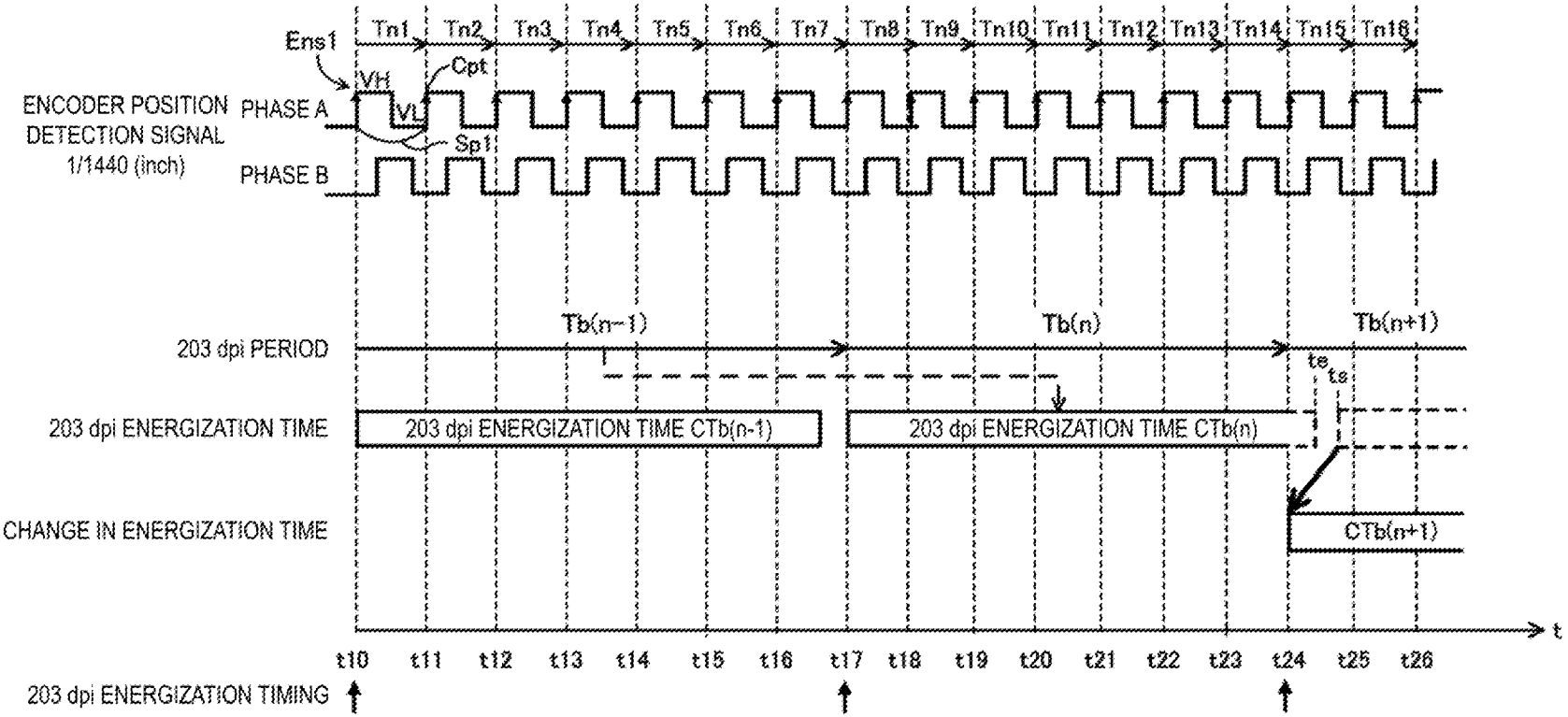
FIG. 5 is an explanatory diagram of a process for dealing with variations in transport speed of the thermal paper.

Referring to FIG. 5, a process of changing the energization time for the thermal head 70 is described. FIG. 5 is an explanatory diagram of a process for dealing with variations in the transport speed of the thermal paper. FIG. 5 illustrates, in order from the upper side with respect to a common time axis t, a position detection signal detected from the encoder 50, a period corresponding to 203 dpi, an energization time corresponding to 203 dpi, a change in the energization time, and an energization timing corresponding to 203 dpi.

FIG. 5 illustrates a case where the transport speed of the thermal paper TP has changed during printing, and the present control period Tb(n) is shorter than the preceding control period Tb(n−1). As described above, the thermal head energization control section 23 determines the energization time CTb(n) in the present control period Tb(n) in accordance with the time of the preceding control period Tn(n).

As a result, when the transport speed of the thermal paper TP has changed such that the present control period Tb(n) becomes shorter than the preceding control period Tb(n−1), the next energization timing t24 might come before the energization time CTb(n) in the present control period Tb(n) has elapsed. In this case, when the energization of the thermal head 70 in the control period Tb(n+1) is started after waiting until the elapse of the energization time CTb(n), the start of printing in the control period Tb(n+1) is delayed, and a printing dropout occurs.

In view of this, in the case where the energization timing t24 of the next control period Tb(n+1) comes before the energization time Tb(n) elapses, the thermal head energization control section 23 shortens the energization time Tb(n) and terminates the energization in the present control period Tb(n). Then, the energization for the thermal head 70 in the next control period Tb(n+1) is started from t24. It is thus possible to prevent printing failures that are caused when the transport speed of the thermal paper TP is increased and the start of the energization of the thermal head 70 in the next control period is delayed.

4. Flow of a Series of Printing Processes

Figure 6:
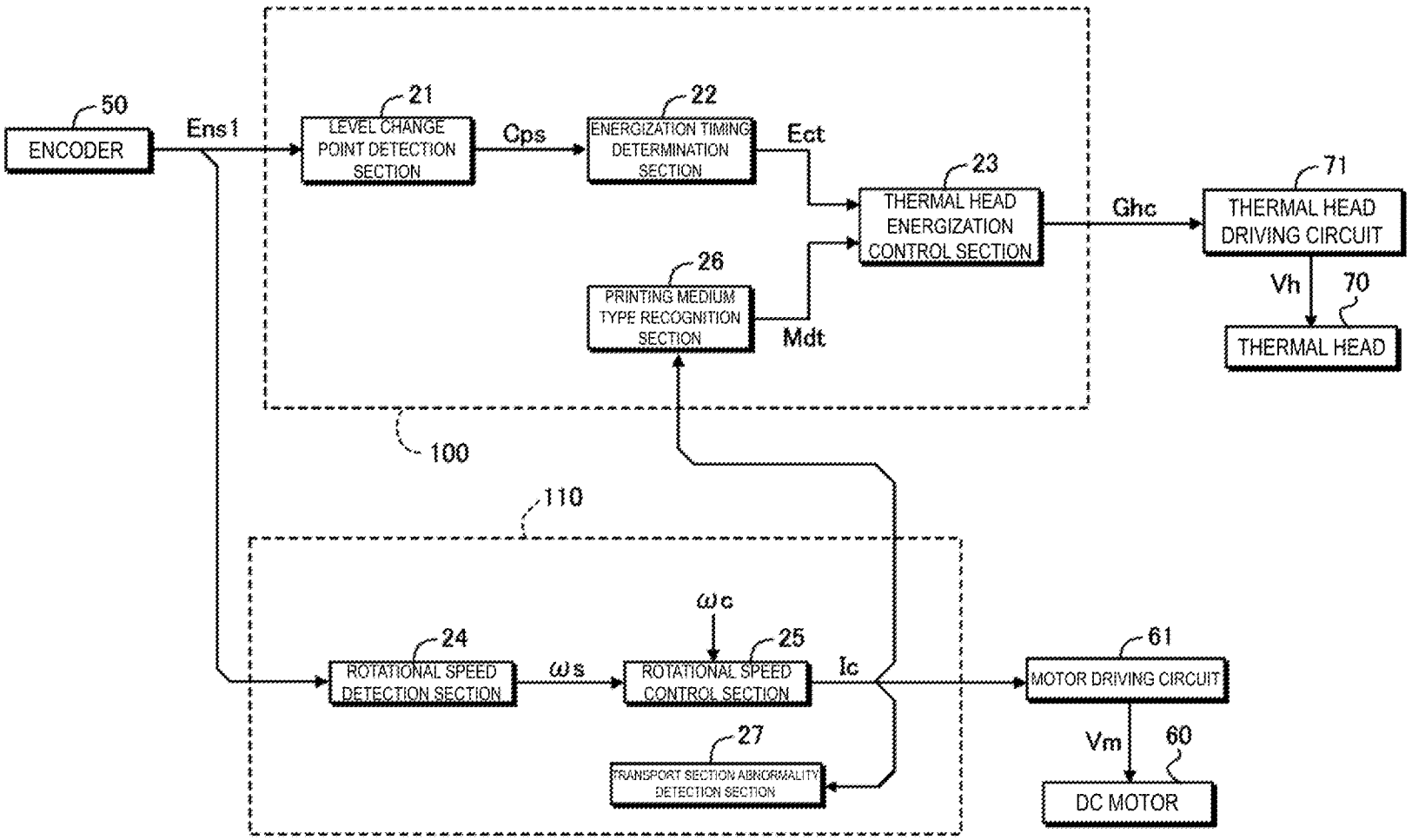
FIG. 6 is a diagram illustrating a process flow of a control unit.

A printing process on the thermal paper TP that is executed by the control unit 10 is described with reference to FIG. 6. FIG. 6 is a flow diagram of a series of printing processes executed by the control unit 10. In terms of the functions, the control unit 10 is divided into a speed control block 110 that performs the rotational speed control of the DC motor 60 and an energization control block 100 that performs the energization control for the thermal head 70.

In the speed control block 110, a first position detection signal Ens1 output from the encoder 50 is input to the rotational speed detection section 24. The rotational speed detection section 24 detects an actual rotational speed ωs of the DC motor 60 on the basis of the frequency of the first position detection signal Ens1. The rotational speed control section 25 calculates a target current value Ic for the DC motor 60 to reduce the difference between the target rotational speed ωc corresponding to the set value of the transport speed of the thermal paper TP and the actual rotational speed ωs.

Then, the rotational speed control section 25 outputs the target current value Ic to the motor driving circuit 61, the transport section abnormality detection section 27, and the recording medium type recognition section 26. The motor driving circuit 61 determines the motor drive voltage Vm that is applied to the DC motor 60 by PWM control such that a current of the target current value Ic is supplied to the DC motor 60. Thus, the actual rotational speed ωs of the DC motor 60 is controlled to the target rotational speed ωc.

The transport section abnormality detection section 27 detects an abnormality of the transport section on the basis of the target current value Ic. As described above, the energization amount required for rotating the DC motor 60 at the target rotational speed ωc increases as the transport load increases. Accordingly, when the target current value Ic becomes equal to or greater than a predetermined abnormality determination value, the transport section abnormality detection section 27 detects that an abnormality in the transport section has occurred and provides an abnormality notification.

In the energization control block 100, the first position detection signal Ens1 output from the encoder 50 is input to the level change point detection section 21. The level change point detection section 21 detects the level change point Cpt for the first position detection signal Ens1. The energization timing determination section 22 counts the level change point Cpt detected by the level change point detection section 21. Then, the thermal head energization control section 23 provides the thermal head energization control section 23 with an instruction for the energization timing Ect each time a predetermined number of level change points Cpt set in accordance with the print resolution of the thermal head 70 is counted.

The recording medium type recognition section 26 recognizes the type Mdt of the thermal paper TP on the basis of the size of the target current value Ic when the actual rotational speed ωs of the DC motor 60 is controlled to the target rotational speed ωc by the rotational speed control section 25. Then, when inputting the energization timing Ect, the thermal head energization control section 23 outputs, to the thermal head driving circuit 71, an energizing instruction signal Ghc for the thermal head driving circuit 71 on the basis of the time of the preceding control period and the type of the recording medium. The thermal head driving circuit 71 applies a head drive voltage Vh to the thermal head 70 while energizing is instructed by the energizing signal Ghc, and thus printing on the thermal paper TP is performed.

5. Increasing Resolution of Position Detection Signal

Figure 7:
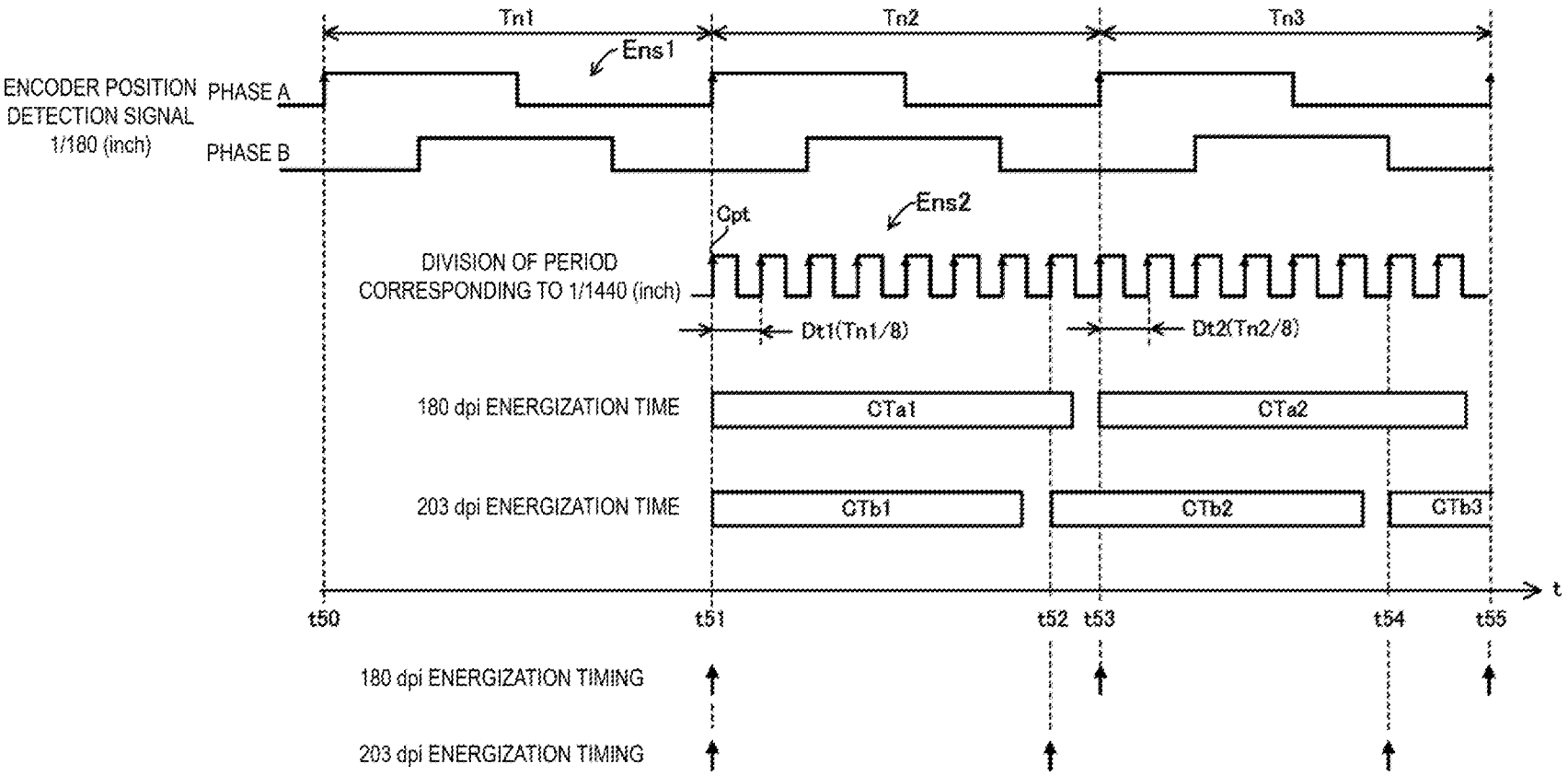
FIG. 7 is an explanatory diagram of a process of increasing a resolution of a detection signal of an encoder.

While the first position detection signal Ens1 output from the encoder 50 is used to determine the energization timing for the thermal head 70 in the above-described embodiment, a second position detection signal Ens2 generated by the high-resolution processing section 28 may also be used. FIG. 7 is an explanatory diagram of a process of increasing the resolution of a detection signal of the encoder.

FIG. 7 illustrates, in order from the upper side with respect to a common time axis t, a position detection signal output from the encoder 50, a position detection signal generated by increasing the resolution by dividing the period, an energization time corresponding to 180 dpi, and an energization time corresponding to 203 dpi. Further, an energization timing corresponding to 180 dpi and an energization timing corresponding to 203 dpi are illustrated.

Here, a process is described in which the high-resolution processing section 28 generates the second position detection signal Ens2 by increasing the resolution of the first position detection signal Ens1 that is the position detection signal of the phase A output from the encoder 50. The high-resolution processing section 28 replaces the period between the level change points t51 and t53 of the period Tn2 of the first position detection signal Ens1 with eight second detection pulses Sp2 whose one period is time Dt1 that is ⅛ of the preceding period Tn1. Thus, the second position detection signal Ens2 whose resolution is increased eight-fold is generated.

Likewise, the high-resolution processing section 28 replaces the period between the level change points t53 and t55 of the period Tn3 with eight second detection pulses Sp2 whose one period is time Dt2 that is ⅛ of the preceding period Tn2 to generate the second position detection signal Ens2.

Then, the level change point detection section 21 detects, as the level change point Cpt, a time at which the output level changes from the second level VL to the first level VH in the second position detection signal Ens2. In this manner, printing in accordance with the thermal head 70 having different print resolutions can be performed by using the encoder 50 having a resolution of 180 pulses/inch in a similar manner as an encoder having a resolution of 1440 pulses/inch.

Other Embodiments

While the transport section abnormality detection section 27 that detects an abnormality of the transport section on the basis of the target current value Ic for the DC motor 60 is provided in the above-described embodiment, the transport section abnormality detection section 27 may be omitted.

While the recording medium type recognition section 26 is provided and the thermal head energization control section 23 determines the energization time for the thermal head 70 on the basis of the type of the thermal paper TP in the above-described embodiment, the recording medium type recognition section 26 may be omitted.

While the rotational speed detection section 24 detects the rotational speed of the DC motor 60 on the basis of the position detection signal output from the encoder 50 in the above-described embodiment, a speed sensor that detects a rotational speed may be provided separately from the encoder 50.

In the above-described embodiment, the encoder 50 is provided coaxially with the rotational shaft 81 of the platen 80. With this configuration, the influence of the backlash of the gear of the transmission mechanism 65 or the like is eliminated, and the actual paper feed state can be detected with high accuracy, and thus, the print quality can be improved.

As another embodiment, the encoder 50 may be provided on the rotational shaft of the DC motor 60. With this configuration, the rotation amount of the DC motor 60 before the rotation amount is decelerated by the transmission mechanism 65 can be detected, and thus the resolution of the paper feed detection can be increased. Further, depending on the layout of the gear trains of the transmission mechanism 65, installation of the encoder 50 can be eased than in the case where the encoder 50 is provided on the rotational shaft 81 of the platen 80.

In the above-described embodiment, as illustrated in FIG. 7, the high-resolution processing section 28 generates the second position detection signal Ens2 by increasing resolution of the first position detection signal Ens1 by performing an arithmetic process of dividing the preceding period of the first position detection signal Ens1 output from the encoder 50 into eight portions. As another configuration, the second position detection signal Ens2 may be generated using a multiplication circuit that multiplies the frequency with inputs of the pulse signals of phase A and phase B output from the encoder 50.

At least some of the functional blocks illustrated in FIG. 1 may be achieved in the form of hardware or may be achieved by a cooperation of hardware and software, and, is not limited to a configuration in which independent hardware resources are arranged as illustrated in the drawings. The program executed by the CPU 20 may be stored in a storage device configured separately from the printing apparatus 1 as well as in the memory 30. Also, a configuration may be adopted in which the CPU 20 acquires and executes a program stored in an external device.

In addition, the specific details of other parts of the devices of the printing apparatus 1 may be modified as desired within the spirit of the present disclosure.

What is claimed is:

1. A printing apparatus comprising:

a transport roller configured to transport a recording medium;

a DC motor configured to drive the transport roller;

a thermal head including a plurality of heating members that generate heat when energized;

an encoder configured to output a first detection pulse in response to a rotation of the DC motor; and a processor configured to control the DC motor and the thermal head, wherein the processor measures a number of the first detection pulses output by the encoder;

starts energization for the thermal head when the number of the first detection pulses measured by the processor becomes a predetermined number; and changes, in accordance with a print resolution of the thermal head, an energization timing for starting the energization for the thermal head.

2. The printing apparatus according to claim 1, wherein the encoder outputs one of the first detection pulses each time the DC motor rotates by a predetermined angle, and when the DC motor rotates by the predetermined angle, a transport amount of the recording medium by the transport roller is ⅓ or less of a spacing between the heating members provided in the thermal head.

3. The printing apparatus according to claim 1, wherein the processor determines an energization time corresponding to an nth energization timing, based on a time from an n−1th energization timing to the nth energization timing, and in a case where there is an n+1th energization timing in a period from the nth energization timing until elapse of the energization time, the processor starts the energization time corresponding to the n+1th energization timing without elapse of the energization time corresponding to the nth energization timing.

4. The printing apparatus according to claim 1, wherein the processor detects a rotational speed of the DC motor;

controls an energization amount for the DC motor to reduce a difference between a detected actual rotational speed of the DC motor and a predetermined target rotational speed of the DC motor; and determines a type of the recording medium, based on the energization amount for the DC motor.

5. The printing apparatus according to claim 1, wherein the processor detects a rotational speed of the DC motor;

controls an energization amount for the DC motor to reduce a difference between a detected actual rotational speed of the DC motor and a predetermined target rotational speed of the DC motor; and detects an abnormality, based on the energization amount for the DC motor.

6. The printing apparatus according to claim 1, wherein the encoder is provided to a rotational shaft of the transport roller.

7. The printing apparatus according to claim 1, wherein the encoder is provided to a rotational shaft of the DC motor.

8. A method of controlling a printing apparatus, the printing apparatus including:

a transport roller configured to transport a recording medium;

a DC motor configured to drive the transport roller;

a thermal head including a plurality of heating members that generate heat when energized; and an encoder configured to output a first detection pulse in response to a rotation of the DC motor, the method comprising:

measuring a number of the first detection pulses output by the encoder;

starting energization for the thermal head when the number of the first detection pulses measured becomes a predetermined number; and changing, in accordance with a print resolution of the thermal head, an energization timing for starting the energization for the thermal head.

* * * * *